US007470085B1

(12) United States Patent
Suazo

(10) Patent No.: US 7,470,085 B1
(45) **Date of Patent: *Dec. 30, 2008**

(54) TIGHTLY PEAKED DITCH LINER SYSTEM

(75) Inventor: Kenneth L. Suazo, Espanola, NM (US)

(73) Assignee: FastDitch, Inc., Espanola, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/649,510

(22) Filed: Jan. 4, 2007

Related U.S. Application Data

(62) Division of application No. 10/837,213, filed on Apr. 30, 2004, now Pat. No. 7,165,914.

(51) Int. Cl.
*E02B 13/00* (2006.01)

(52) U.S. Cl. ..... 405/49; 405/121; 405/119

(58) Field of Classification Search ..... 405/118–123, 405/268, 270, 49; 138/173, 121
See application file for complete search history.

(56) References Cited

U.S. PATENT DOCUMENTS 3,156,099 A * 11/1964 Dailey ..... 405/121
3,854,292 A * 12/1974 Nienstadt ..... 405/270
5,193,588 A * 3/1993 Kanao ..... 138/133
6,273,640 B1 * 8/2001 Suazo ..... 405/121
6,692,186 B1 * 2/2004 Suazo et al. ..... 405/118
6,722,818 B1 * 4/2004 Suazo et al. ..... 405/121
7,165,914 B2 * 1/2007 Suazo ..... 405/121

* cited by examiner

*Primary Examiner*—Frederick L Lagman
(74) *Attorney, Agent, or Firm*—Ray R. Regan

(57) ABSTRACT

The specification and drawing figures describe and show one or more improved ditch liners removably assembled into an improved ditch liner system. The improved ditch liner system includes a first liner section and a second liner section. Both liner sections are formed with a plurality of tightly peaked arc-and-ridge corrugations. Also included is a novel and unique overlap connection assembly for removably connecting one liner section to another liner section. In addition, various ways for sealing the overlap connection assembly are included. The interconnected system of improved ditch liner sections may be secured in a ditch by one or more removably rods. This abstract is provided to comply with rules requiring an abstract that will allow a searcher or other reader to quickly ascertain the subject matter of the technical disclosure, but this abstract is not to be used to interpret or limit the scope or meaning of any claim.

17 Claims, 9 Drawing Sheets

TIGHTLY PEAKED DITCH LINER SYSTEM

CROSS-REFERENCE TO RELATED APPLICATION

This application is a divisional of U.S. application Number filed for AN IMPROVED DITCH LINER SYSTEM filed on Apr. 30, 2004, application No. 10/837,213, now U.S. Pat. No. 7,165,914 for which a Notice of Allowance issued on Sep. 12, 2006. The specification and disclosures of the prior application are incorporated by reference into this document.

FIELD OF TECHNOLOGY

The improved ditch liner system disclosed and claimed in this document pertains generally to transportation of water through interconnected improved ditch liners. More particularly, the new and useful improved ditch liner system not only conveys water through gravity fed irrigation ditches, but also reduces water loss during transportation of water through irrigation ditches lined with the improved ditch liner.

BACKGROUND

Gravity fed ditches formed in earth for conveying water to a point or location for use has been in common use for generations throughout the world. As used in this document, the term "ditch" includes any excavation dug in earth that also may be referred to as a drain, channel, canal or acequia. Ditches have, and continue to be, used to transport both potable and irrigation water. Earthen irrigation ditches continue to be significant transporters of water, particularly to convey surface irrigation water to crops. Earthen ditches, relying on principles of gravity flow to transport water along descending elevations of a ditch, continue to be popular because they provide low-cost irrigation systems.

As provided in U.S. Pat. No. 6,273,640 B1 issued on Aug. 14, 2001, to Kenneth L. Suazo, U.S. Pat. No. 6,692,186 B1 issued on Feb. 17, 2004 to Suazo, et al., and U.S. Pat. No. 6,722,818 B1 issued on Apr. 20, 2004, (collectively, the "Earlier Suazo Patents"), concrete is a common material used to line earthen ditches. Concrete, however, as also shown in the Earlier Suazo Patents, have several material deficiencies and limitations, including material inconsistencies, cracking, and failure that lead to considerable water loss due to seepage, erosion, evaporation, and trans-evaporation. Water is becoming an ever more precious and valuable resource and commodity; water loss is unacceptable. Water uses continue to increase, while the finite amount of available water does not. Installation and use of the apparatus and methods for reducing water loss disclosed and claimed in the Earlier Suazo Patents renders loss of water not only unacceptable, but also unnecessary.

The improved ditch liner system disclosed and claimed in this document makes further optimizations and contributions to the art disclosed and claimed in the Earlier Suazo Patents. Alternative features and elements disclosed and claimed in this document include at least the capacity of the improved ditch liner to further reduce water loss during transportation of water through ditches that have been lined with the improved ditch liner. The improved ditch liner system also ensures a water-tight connection between interconnected improved ditch liner sections, while enhancing the flow of water through the improved ditch liners. The improved ditch liner system may be installed either permanently or temporarily in either concrete lined ditches or earthen ditches. The improved ditch liner system is easy to install, lightweight, and will transport water at greater efficiency while, as stated, while reducing loss of water during conveyance. The improved ditch liners also reduces maintenance problems accompanying insiltation, cleaning and maintenance of conventional concrete lined ditches and earthen ditches. The improved ditch liner system is durable, flexible, and cost-effective. The improved ditch liner system, therefore, provides efficient management and conservation of surface water.

At least one contribution to the art made by the improved ditch liners and improved ditch liner system disclosed and claimed in this document is its capability to overcome undersirable effects of friction between (i) a boundary of a moving body of water in contact with, and moving through a ditch liner system, and (ii) the inner surface of the improved ditch liner. The term "friction" as used in this document means the force of resistance caused by one surface on another. Forces of resistance tend to prevent or retard slipping or movement of the water along a ditch liner. Forces of resistance may also cause damage to a ditch liner and to a ditch liner system.

As is known to those skilled in the art, forces of resistance always act tangentially to a surface at points of contact with the surface. Further, the force is a function of, or proportional to, the normal force, and is exposed as the "coefficient of static friction" in a stationary body, or "coefficient of kinetic friction" in a moving body. A coefficient of friction is a dimensionless number that depends on characteristics of the contacting surfaces, or in this instance, the characteristics of the boundary of a moving body of water, and the contact surface of the improved ditch liner. It is known that the coefficient of friction varies with temperature, humidity, pressure, the materials in contact, the sliding velocity of the body moving in relation to a surface, and whether the body and surface are dry or lubricated. It also is known to those skilled in the art that when two surfaces, or a boundary and a surface, move relative to each other, a lateral force is required to overcome adhesion, a force is referred to as "adhesional friction force." It also is known that the contacts between surfaces moving relative to each other depend primarily on the surface topography and the mechanical properties of the mating surfaces.

To overcome undesirable results of such forces and coefficients, studies and experimentation confirmed the usefulness of reconfiguring the radial geometry of corrugations in the improved ditch liner. The novel tightly-peaked radial geometry of corrugations used in the improved ditch liner section substantially improves flow efficiency by altering undesirable coefficients, including the Manning resistance coefficients. Lowering the Manning resistance coefficients by use of the arc-and -ridge corrugations of the improved ditch liner was an unexpected result.

To achieve a substantially zero-loss water-tight seal between interconnectable nested ends of the improved ditch liner, the inventors also determined that a number of features could contribute to that goal. Corrugations extend substantially the entire length of each improved ditch liner section. The material used to manufacture each improved ditch liner section is the same; restated, different materials are not combined to make the improved ditch liner. Demountably interconnectable male-female opposing ends of each improved ditch liner section are formed with a channel into which a hydrophilic sealant, such as a vulcanized rubber hydrophilic seal, may be inserted. To reduce costs associated with manufacturing the improved ditch liner sections, the process of manufacturing is a rotational molding process, although a watertight seal using a plastic material has not previously been achieved using rotational molding.

SUMMARY

One or more improved ditch liners may be removably assembled into an improved ditch linear system. The improved ditch liner system includes a first liner section and a second liner section. Both liner sections are formed with a plurality of unique and novel tightly peaked arc-and-ridge corrugations that reduce or eliminate undesirable forces of friction and coefficients of friction to enhance water flow through the improved ditch liners. Also included is a novel and unique overlap connection assembly for removably connecting one liner section to another liner section. In addition, means for sealing the overlap connection assembly are included. An interconnected system of improved ditch liner sections may be secured in a ditch by one or more removable rods.

It will become apparent to one skilled in the art that the claimed subject matter as a whole, including the structure of the apparatus, and the cooperation of the elements of the apparatus, combine to result in a number of unexpected advantages and utilities. The structure and co-operation of structure of the will become apparent to those skilled in the art when read in conjunction with the following description, drawing figures, and appended claims. Accordingly, the foregoing has outlined broadly the more important features of the improved ditch liner to better understand the detailed description that follows, and to better understand the contributions to the art. The improved ditch liner system disclosed and claimed in this document is not limited in application to the details of construction, and to the arrangements of the components, provided in the following description and drawing figures, but is capable of other embodiments, and of being practiced and carried out in various ways. The phraseology and terminology employed in this disclosure are for purpose of description, and therefore should not be regarded as limiting. As those skilled in the art will appreciate, the conception on which this disclosure is based readily may be used as a basis for designing other structures, methods, and systems. The claims, therefore, include equivalent constructions. Further, the abstract associated with this disclosure is intended neither to define the improved liner system, which is measured by the claims, nor intended to limit the scope of the claims. The novel features of the improved ditch liner are best understood from the accompanying drawing, considered in connection with the accompanying description of the drawing, in which similar reference characters refer to similar parts, and in which:

DETAILED DESCRIPTION

Figure 1:
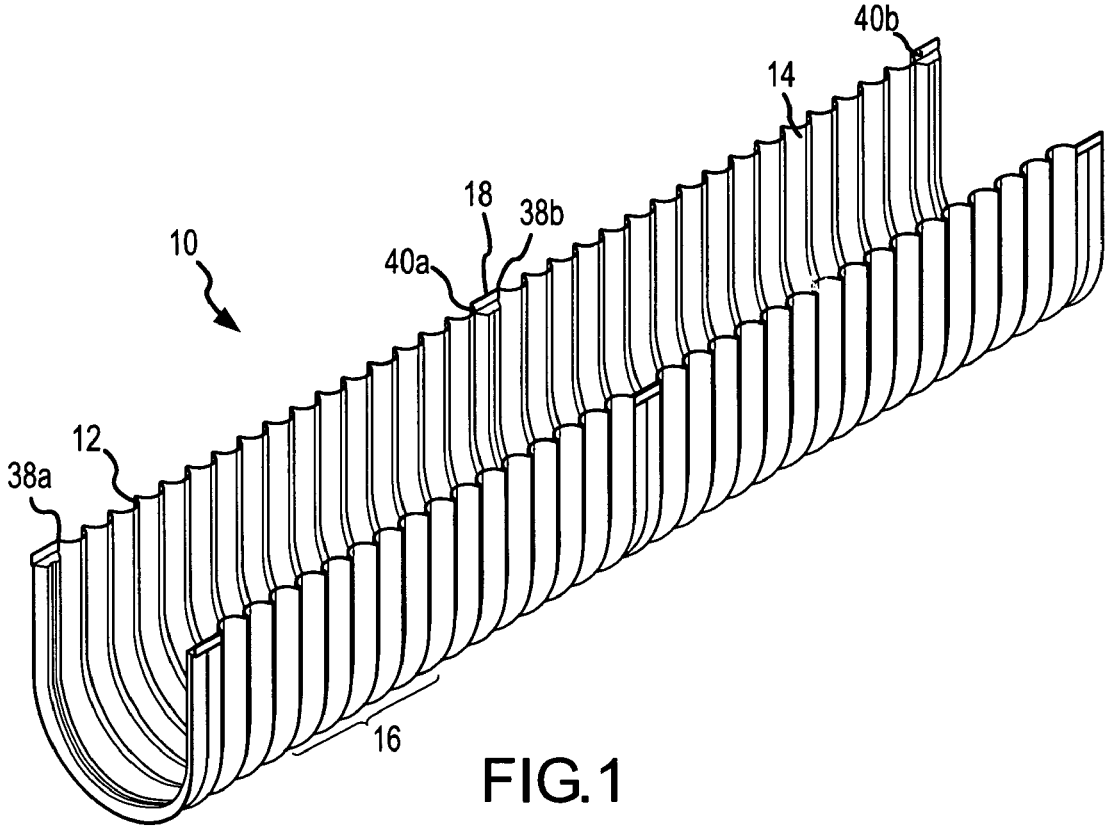
FIG. 1 of the drawing is a perspective view of the improved ditch liner.
Figure 2:
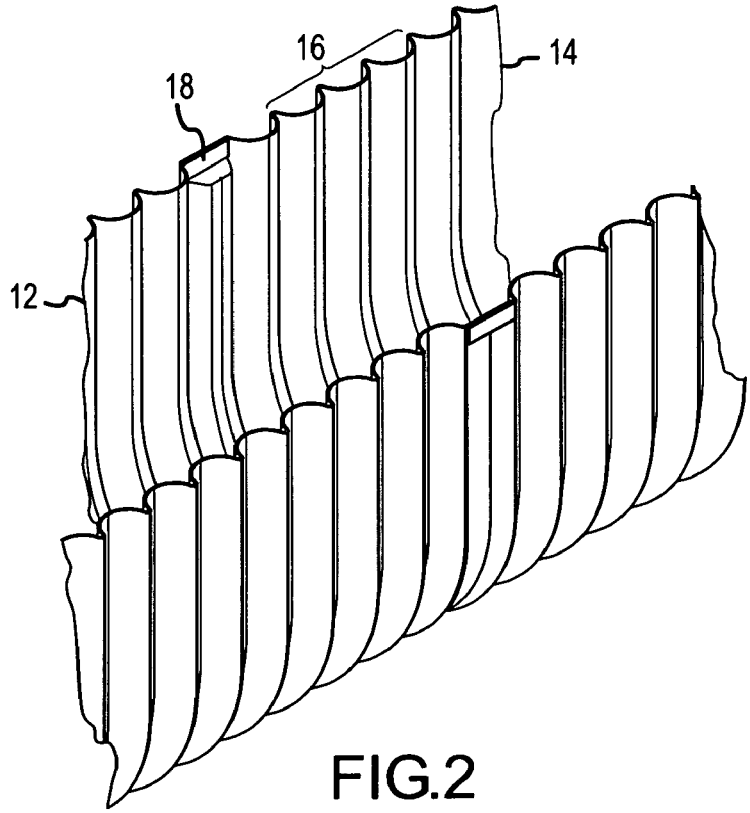
FIG. 2 is a diametric zoom view of a portion of the wall of the improved ditch liner.
Figure 3:
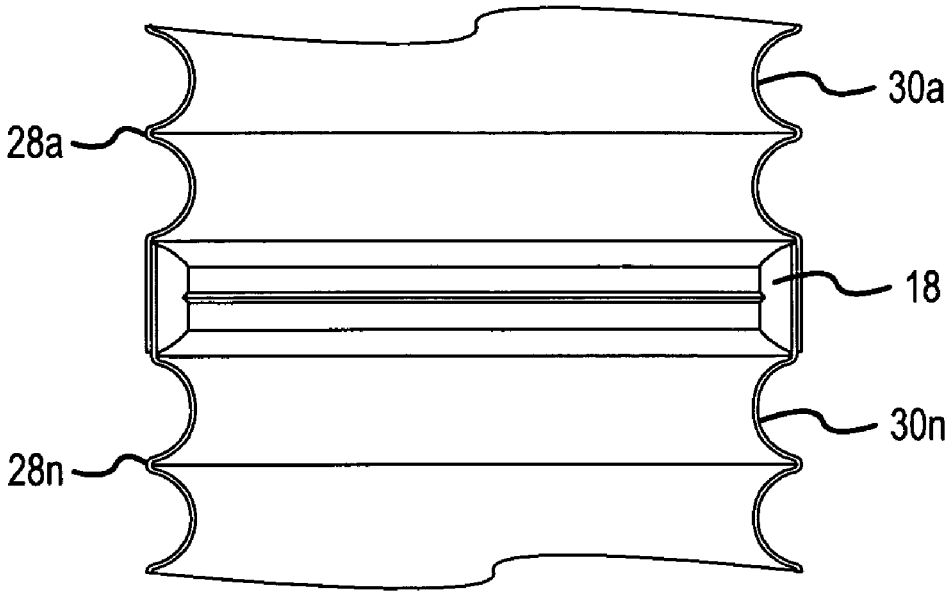
FIG. 3 is a top view of the overlap connection assembly.

As shown in FIGS. 1 through 6C, an improved ditch liner system 10 is provided that in its broadest context includes a first liner section 12 and a second liner section 14 formed with a plurality of tightly peaked arc-and-ridge corrugations 16 that are perhaps best shown by cross-reference between FIGS. 4D through 4G. An overlap connection assembly 18 for removably connecting first liner section 12 and second liner section 14 is provided. In addition, means 20 for sealing overlap connection assembly 18 are included as perhaps best shown by cross-reference between FIGS. 4B-4C. An interconnected system 10 of improved ditch liner sections 12 and 14 may be secured in a ditch by one or more rods 22 as shown in FIGS. 6B.

More specifically, as shown in FIG. 1, improved ditch liner system 10 includes first liner section 12 and second liner section 14. In the embodiment shown in FIG. 1, first liner section 12 and second liner section 14 are semi-circular in cross-section. As will be evident to one skilled in the art, first liner section 12 and second liner section 14 may be made in a variety of shapes that include cross-sectional shapes selected from the group of shapes and portions of shapes consisting of trapezoids, ducts, squares, rectangles, parabolas, and triangles. Cross-sectional shapes of first liner section 12 and second liner section 14 are not material to the practice of improved ditch liner system 10.

As shown in FIGS. 4D-4G, first liner section 12 and second liner section 14 are formed with plurality of tightly peaked arc-and-ridge corrugations 16. In the embodiment illustrated in FIGS. 4D-4G, plurality of tightly peaked arc-and-ridge corrugations 16 includes a plurality of substantially semi-circular ducts 24*a-n* with opposing edges 26*a,b*. To the extent that subscripts to the numerical designations include the lower case letter "n," as in "24*a-n*," the n-term is intended to suggest a large substantially infinite number of repetitions of the elements designated by the numerical reference and subscripts. As shown best in FIG. 4E, opposing edges 26*a,b* of plurality of tightly peaked arc-and-ridge corrugations 16 are joined edge-to-edge to form a ridge 28 between opposing edges 26*a,b* extending the length L1 of semi-circular ducts 24. As shown in one embodiment, ridge 28 is substantially rounded, but the roundness of ridge 28 is not a limitations of ridge 28. In the embodiment illustrated in FIGS. 4D-4G, substantially rounded ridge 28 is formed monolithically adjacent opposing edges 26*a,b* extending the length L1 of semi-circular ducts 24.

Figure 4A:
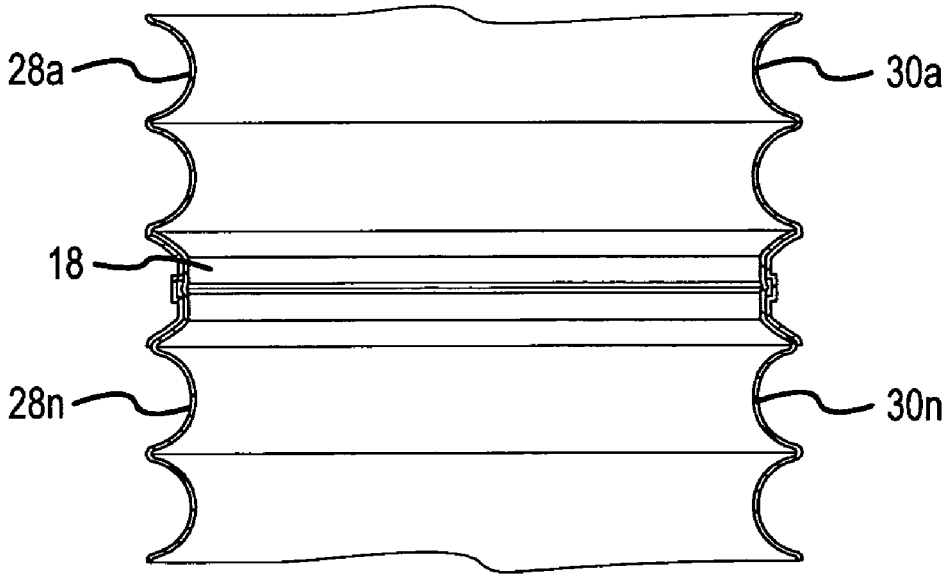
FIG. 4A is a top diagrammatic view of the overlap connection assembly.
Figure 4B:
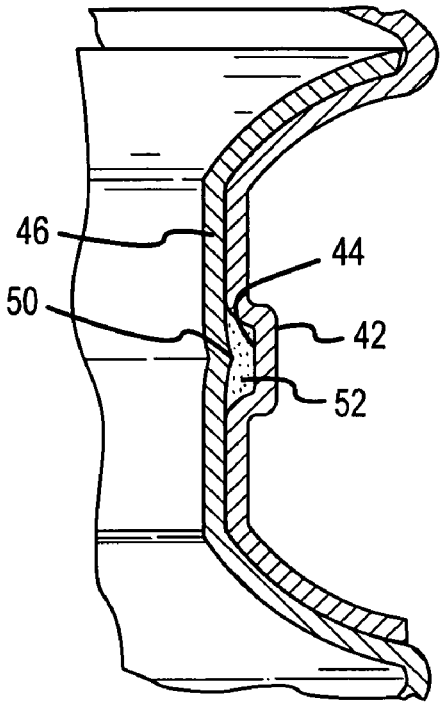
FIG. 4B is an end view of the overlap connection assembly.
Figure 4C:
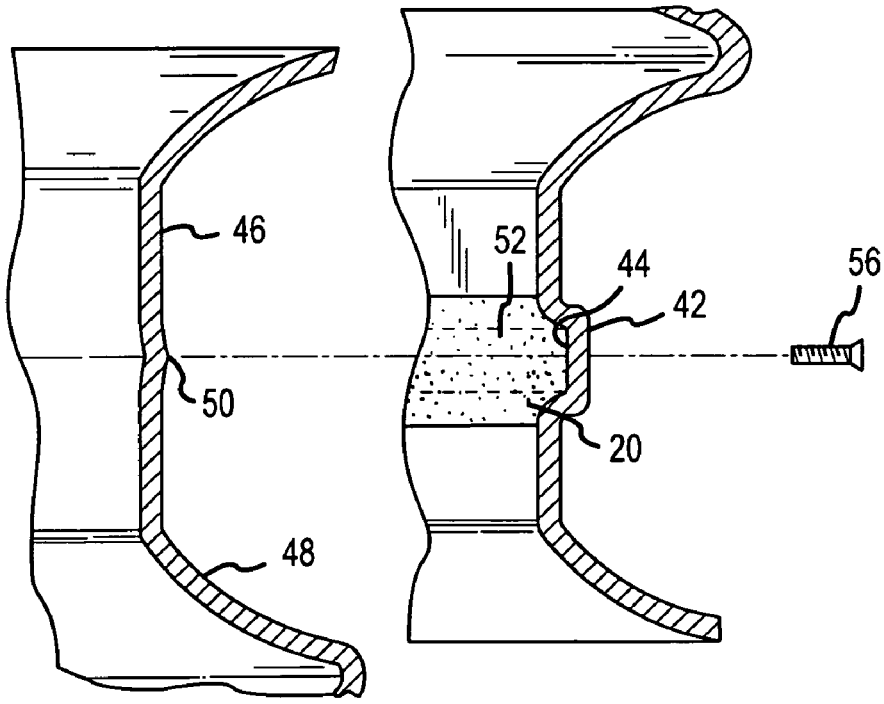
FIG. 4C is an exploded end view of a portion of the overlap connection assembly.
Figure 4D:
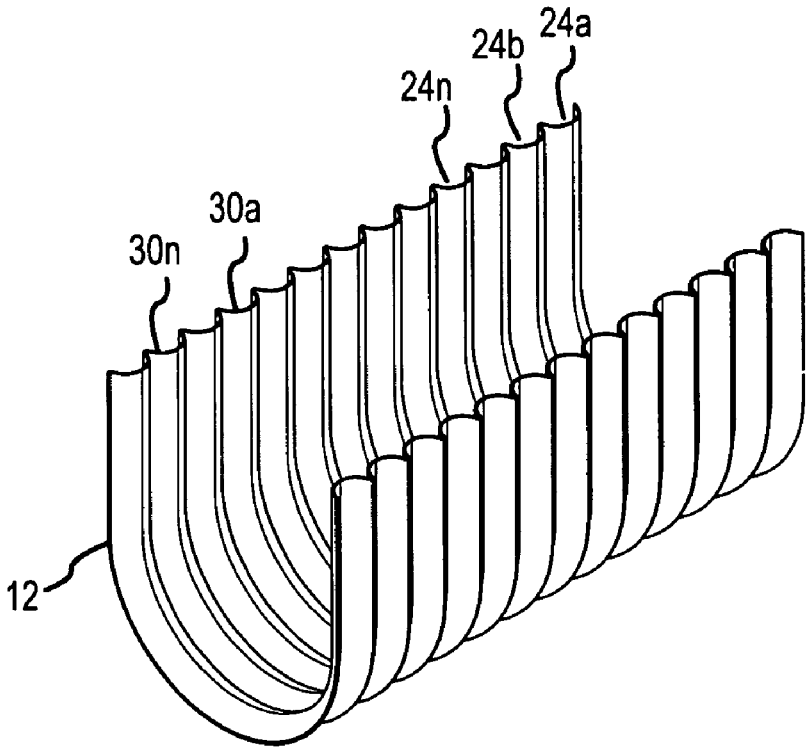
FIG. 4D is a portion of an improved ditch liner showing a perspective view detailing the tightly peaked arc-and-ridge corrugation configurations of the improved ditch liner.
Figure 4E:
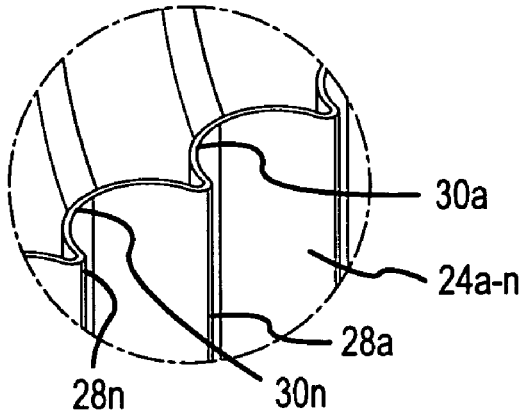
FIG. 4E is a perspective zoom view of a portion of the arc-and-ridge corrugation configurations of the improved ditch liner.
Figure 4F:
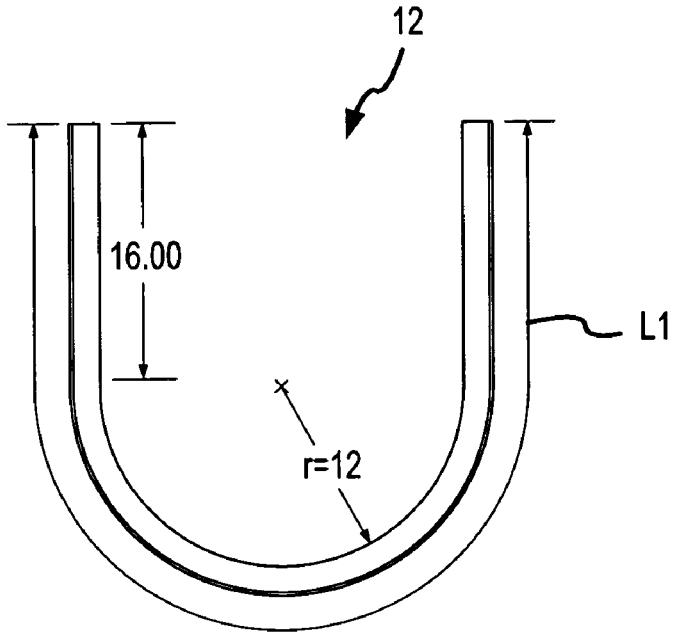
FIG. 4F is an end view of a semi-circular duct of the arc-and-ridge corrugation configurations.
Figure 4G:
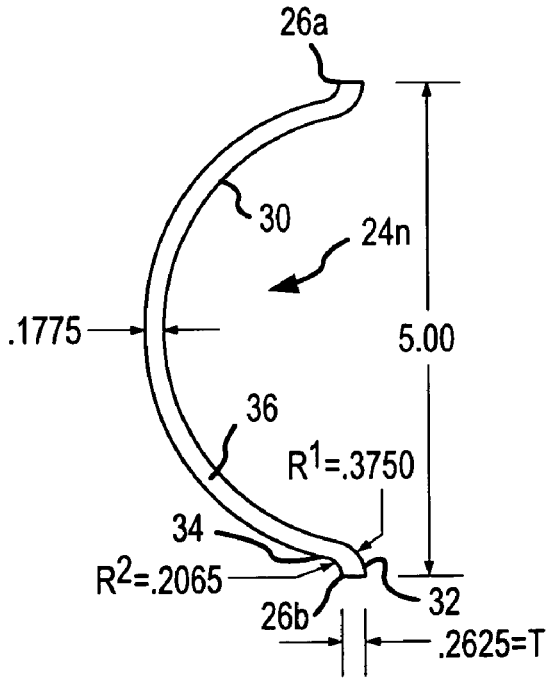
FIG. 4G is an end view of a semi-circular duct of the arc-and-ridge corrugation configurations showing a range of dimensions.
Figure 5A:
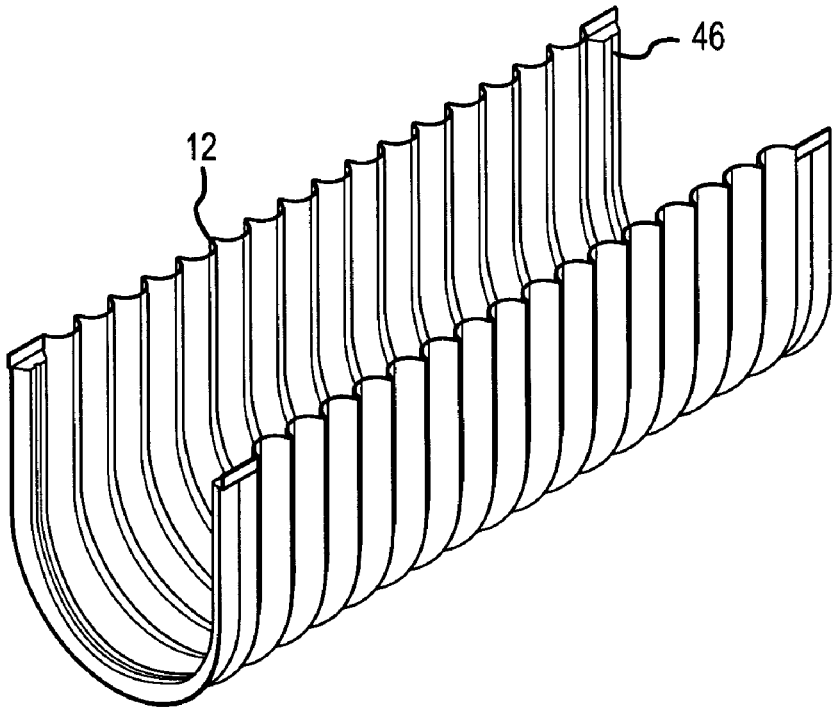
FIG. 5A is a perspective view of the improved ditch liner.
Figure 5B:
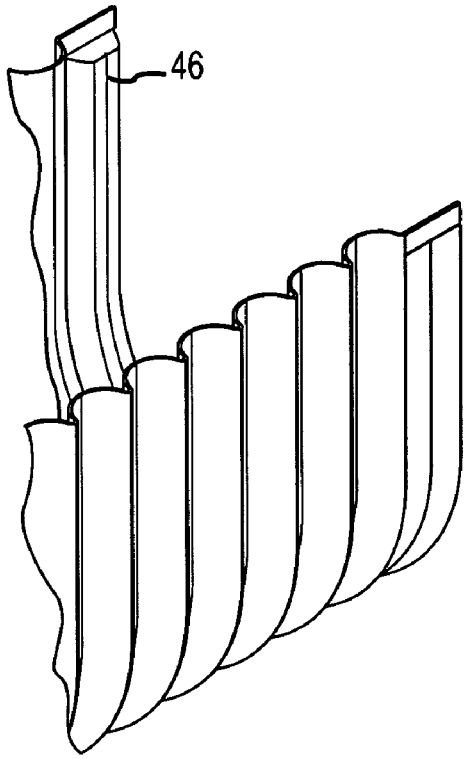
FIG. 5B is a perspective zoom view of the male portion of the overlap assembly of the improved ditch liner.
Figure 5C:
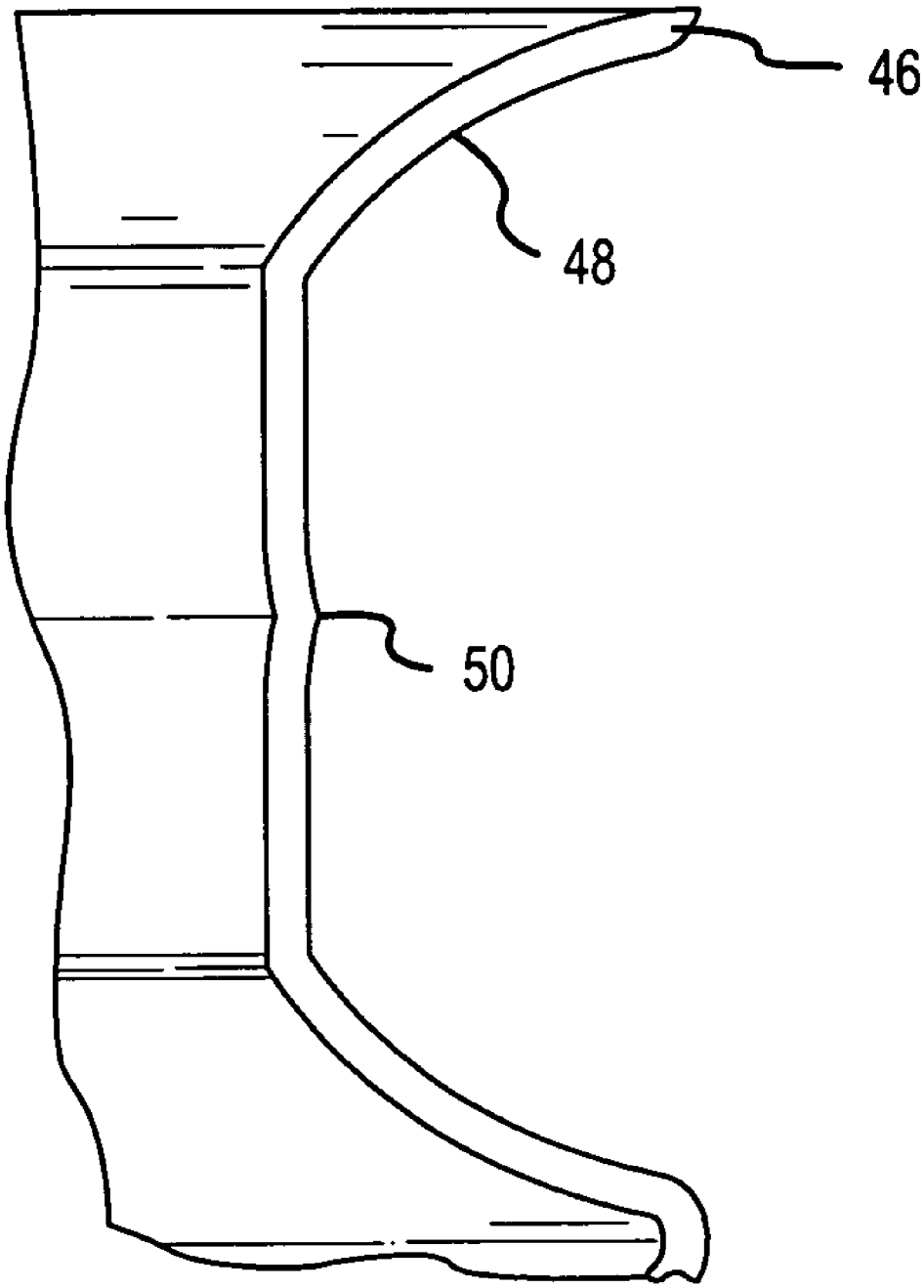
FIG. 5C is an end view of the male portion of the overlap assembly of the improved ditch liner.
Figure 6A:
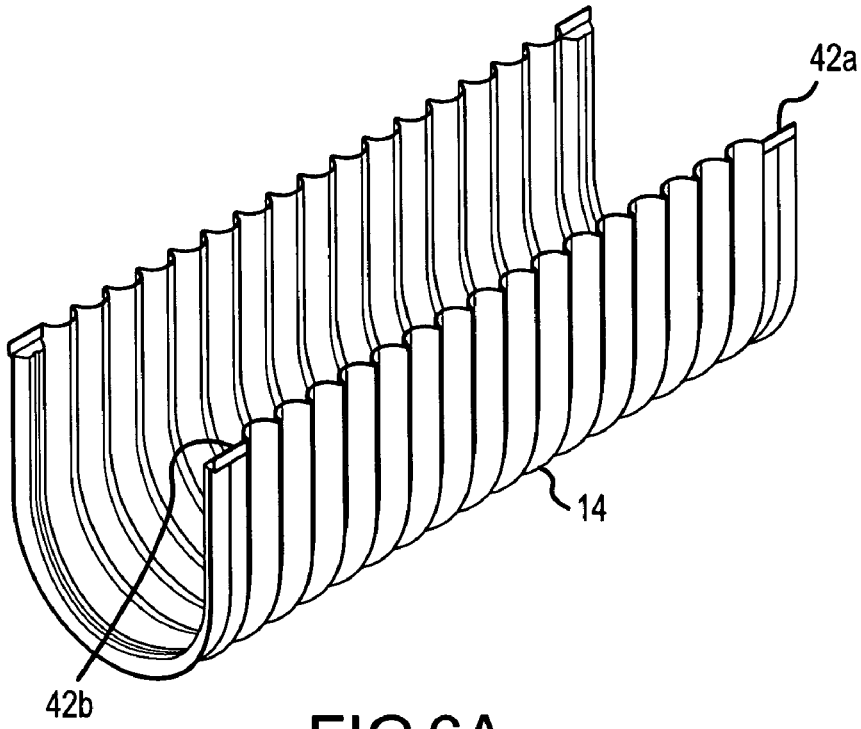
FIG. 6A is a perspective view of the improved ditch liner.
Figure 6B:
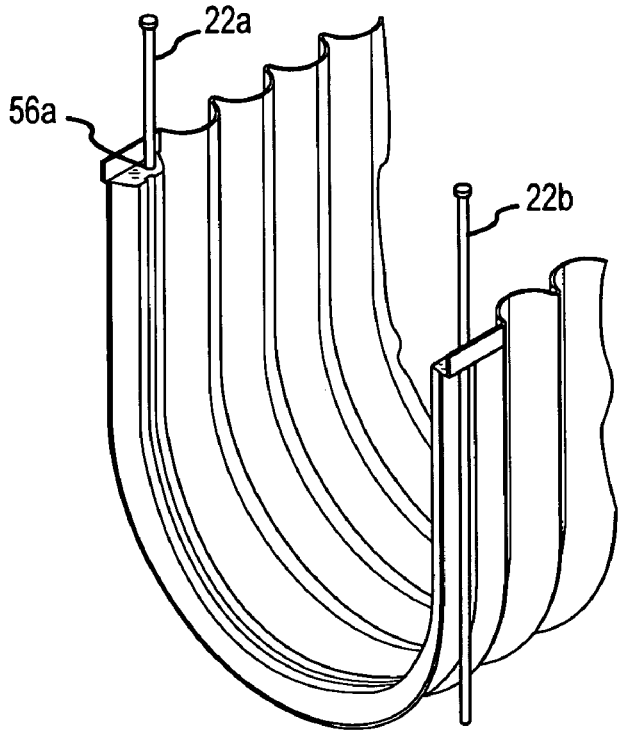
FIG. 6B is a perspective zoom view of the female portion of the overlap assembly of the improved ditch liner.
Figure 6C:
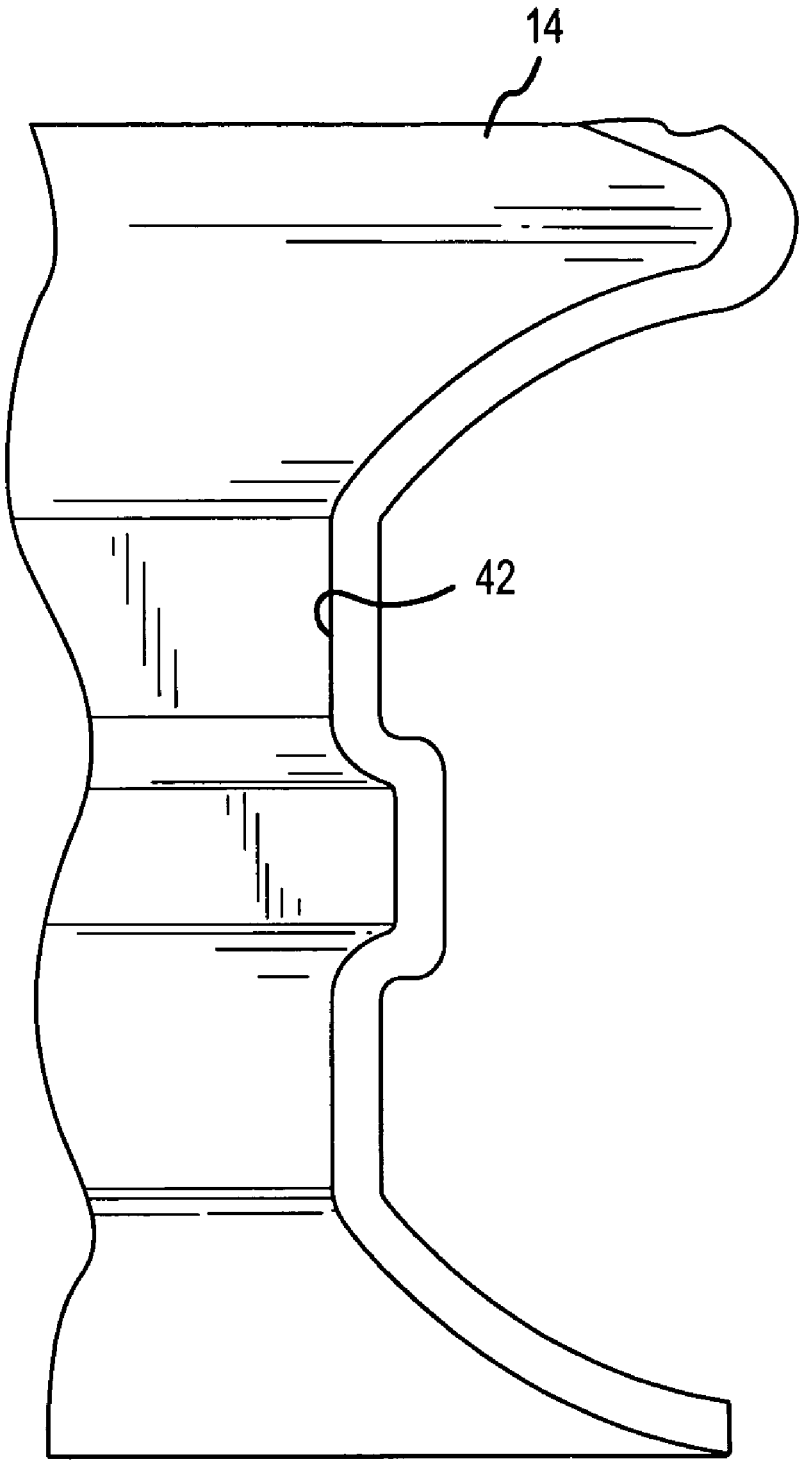
FIG. 6C is an end view of the female portion of the overlap assembly of the improved ditch liner.

Tightly peaked arc-and ridge corrugations 16*a-n* are also shown FIG. 4G. FIG. 4G shows dimensions for the embodiment illustrated in FIGS. 4D-4G. The dimensions shown in FIG. 4G are not limitations of first liner section 12 and second liner section 14. Dimensions shown in FIG. 4G are to suggest ratios and relationships that may be calculated and used to accentuate arcs 30*a-n* in tightly peaked arc-and-ridge corrugations 16*a-n,* as well as the relative size and shape of ridge 28 adjacent opposing edges 26*a,b* extending the length L1 of semi-circular ducts 24. For example, the radius R1 of first curved surface 32 adjacent opposing edge 26*b* of semi-circular duct 24*n* as shown in FIG. 4G is approximately 0.3750 inches. The radius R2 of second curved surface 34 adjacent opposing edge 26*b* of semi-circular duct 24*n* as shown in FIG. 4G is approximately 0.2065 inches. The thickness ("T") of wall 36 of first liner section 12 and second liner section 14 is approximately 0.2625 inches. Accordingly, the comparative ratio of those dimensions, in the embodiment illustrated in FIGS. 4D-4G, which is but not embodiment in a number of possible embodiments of improved first liner section 12 and second liner section 14, is R2=2065: R1=3750: T=2625, or 1:1.82: 1.27. Substantially rounded ridge 28*a* through 28*n* thus are formed with substantially those comparative ratios.

FIG. 4F also shows dimensions that are shown only to demonstrate a range of ratios rather than to limit the embodiment illustrated in FIGS. 4D-4G. Again, however, neither the comparative ratios nor the dimensions are limitations on improved ditch liner system 10. The embodiment illustrated in FIGS. 4D-4G is but one embodiment in a number of possible embodiments of improved first liner section 12 and second liner section 14, and the dimensions shown in FIG. 4F are but one embodiment of several.

As also shown in FIG. 1, first liner section 12 and second liner section 14 are formed with a proximal end 38 and a distal end 40. Plurality of tightly peaked arc-and-ridge corrugations 16 extends substantially the length of first liner section 12 and second linear section 14 between the proximal end 38 and the distal end 40. Overlap connection assembly 18 for removably connecting the first liner section and the second liner section is included, and shown by cross-reference between FIGS. 2, 3, and 4A-4C. Overlap connection assembly 18 includes a chambered female extension 42 formed in proximal end 38 of first liner section 12 and second liner section 14. Chambered female extensions 42 further comprises a channel 44. Overlap connection assembly includes a male extension 46 formed in distal end 40 of first liner section 12 and second liner section 14. As shown in FIGS. 4B-4C, male extension 46 in the embodiment illustrated in FIGS. 4B-4C is shaped as a cup 48, but as will be evident to one skilled in the art, the shape of male extension 46 in the embodiment illustrated in FIGS. 4B-4C is not a limitation of improved ditch liners 12 and 14. In the embodiment illustrated, male extension 46 also includes one or more ribs 50 for restricting lateral movement of male extension 46 within channel 44. As further shown by cross-reference between FIGS. 1, 2, 3, and 4A-4C, male extension 46 and chambered female extension 42 are compressibly connectable. As used in this document, the term "compressibly connectable" means that male extension 46 and snapping together male extension 46 and chambered female extension 42 may connect chambered female extension 42. Further, the term "compressibly connectable" means that mere pressure may be used to connect male extension 46 and chambered female extension 42.

As shown by cross-reference between FIGS. 4B-4C, sealing means 20 includes a sealant 52 removably insertable into channel 44. In the embodiment illustrated in FIGS. 3-4C, sealant 52 is a vulcanized rubber hydrophilic seal. As will be evident to one skilled in the art, however, a vulcanized rubber hydrophilic seal is not a limitation of improved ditch liners 12 and 14. Further, sealing means 20 may also include a connector 56, as shown in FIG. 4C, extractably insertable in overlap connection assembly 18 selected from a group of connectors 56 consisting at least of nylon rivets, rivets, taps, screws, Velcro®, and staples.

In operation, improved ditch liner system 10 may be set in a ditch by forming one or more holes 56 in overlap connection assembly 18, and insertion one or more robs 22 through holes 56 into a ditch.

The improved ditch liner system 10 shown in drawing FIGS. 1-6C is at least one embodiment not intended to be exclusive, but merely illustrative of the disclosed but non-exclusive embodiments. Claim elements and steps in this document have been numbered and/or lettered solely as an aid in readability and understanding. Claim elements and steps have been numbered solely as an aid in readability and understanding. The numbering is not intended to, and should not be considered as intending to, indicate the ordering of elements and steps in the claims. Means-plus-function clauses in the claims are intended to cover the structures described as performing the recited function that include not only structural equivalents, but also equivalent structures. Thus, although a nail and screw may not be structural equivalents, in the environment of the subject matter of this document a nail and screw may be equivalent structures.

What is claimed is:

1. A method for controlling water flow through a ditch, comprising:

selecting a material for forming a plurality of ditch liners;

shaping the material into a plurality of ditch liners, wherein the plurality of ditch liners are formed with a proximal end and distal end, with a wall therebetween, the wall having a plurality of corrugations in the shape of successive arc-and-ridge configurations having a plurality of semi-circular tubes attached to a plurality of ridges;

configuring the plurality of ditch liners for compressible connection; and including means for eliminating water loss from the plurality of ditch liners.

2. A method for controlling water flow through a ditch as recited in claim 1, wherein the eliminating water loss including means includes the substep of installing a sealant between the plurality of ditch liners.

3. A method of making a tightly peaked ditch liner system, comprising:

selecting a plastic material adapted to form components of the tightly peaked ditch liner system;

molding a first liner section formed with a plurality of tightly peaked arc-and-ridge corrugations from the plastic material.

molding a second liner section formed with a plurality of tightly peaked arc-and-ridge corrugations from the plastic material;

configuring the first liner section and the second liner section with an overlap connection assembly for removably connecting the first liner section and the second liner section; and sealing the overlap connection assembly to achieve a substantially zero-loss water-tight seal between interconnectable nested ends of the first linear section and the second liner section.

4. A method of making a tightly peaked ditch liner system as recited in claim 3, further comprising the substeps of forming the first liner section and second liner section with a cross-sectional shape selected from the group of shapes and portions of shapes consisting of trapezoids, ducts, squares, rectangles, parabolas, and triangles.

5. A method of making a tightly peaked ditch liner system as recited in claim 4 wherein the step of molding the plurality of tightly peaked arc-and-ridge corrugations includes the substep of including a plurality of substantially semi-circular ducts having opposing edges.

6. A method of making a tightly peaked ditch liner system as recited in claim 5, wherein the step of molding the plurality of tightly peaked arc-and-ridge corrugations includes the substep of including a substantially rounded ridge monolithically formed adjacent the opposing edges of the substantially semi-circular ducts extending the length of the semi-circular ducts.

7. A method of making a tightly peaked ditch liner system as recited in claim 5, wherein the step of molding the first liner section and the step of molding the second liner section include the substeps of:

forming the first linear section and second liner section having a proximal end and a distal end; and extending the plurality of tightly peaked arc-and-ridge corrugations substantially the length of the first liner section and second liner section between the proximal end and the distal end.

8. A method of making a tightly peaked ditch liner system as recited in claim 5, wherein the step of configuring the first liner section and the second liner section with an overlap connection assembly for removably connecting the first liner section and the second liner section includes the substep of forming a chambered female extension in the proximal end of the first liner section and the second liner section.

9. A method of making a tightly peaked ditch liner system as recited in claim 8, wherein the step of configuring an overlap connection assembly for removably connecting the first liner section and the second liner section includes the substep of providing a channel in the chambered female extension.

10. A method of making a tightly peaked ditch liner system as recited in claim 9, wherein the step of configuring an overlap connection assembly for removably connecting the first liner section and the second liner section includes the substep of forming in the overlap connection assembly a cup-shaped male extension formed in the distal end of the first liner section and in distal end of the second liner section.

11. A method of making a tightly peaked ditch liner system as recited in claim 10, wherein the step of configuring an overlap connection assembly for removably connecting the first liner section and the second liner section includes the substep of forming in the cup-shaped male extension one or more ribs adapted to restrict lateral movement of the cup-shaped male extension within the channel.

12. A method of making a tightly peaked ditch liner system as recited in claim 11, wherein the step of configuring an overlap connection assembly for removably connecting the first liner section and the second liner section includes the substep of shaping the cup-shaped male extension and the chambered female extension to be compressibly connectable.

13. A method of making a tightly peaked ditch liner system as recited in claim 3, wherein the step of sealing the overlap connection assembly to achieve a substantially zero-loss water-tight seal between interconnectable nested ends of the tightly peaked ditch liner system includes the substep of removably inserting sealant into the channel.

14. A method of making a tightly peaked ditch liner system as recited in claim 13, wherein the step of sealing the overlap connection assembly to achieve a substantially zero-loss water-tight seal between interconnectable nested ends of the tightly peaked ditch liner system includes the substep of selecting a vulcanized rubber hydrophilic seal.

15. The method of making at tightly peaked ditch liner system as recited in claim 14, wherein the step of sealing the overlap connection assembly to achieve a substantially zero-loss water-tight seal between interconnectable nested ends of the tightly peaked ditch liner system includes the substep of providing a connector extractably insertable in the overlap connection assembly selected from a group of connectors consisting of nylon rivets, rivets, taps, screws, Velcro®, and staples.

16. A method for controlling water flow through a ditch, comprising:

selecting a material for forming a plurality of ditch liners;

shaping the material into a plurality of ditch liners;

configuring the plurality of ditch liners for compressible connection, wherein the configuring includes:

A) forming a first overlap extension in one of the opposing ends of the plurality of ditch liners that includes a female extension;

B) shaping the female extension to include a channel;

C) forming a second overlap extension in the other of the opposing ends of the plurality of ditch liners that includes a male extension;

D) shaping the male extension to include one or more ribs;

E) configuring the female extension and the male extension to be compressibly connectable; and including means for eliminating water loss from the plurality of ditch liners.

17. A method for controlling water flow through a ditch as recited in claim 16, wherein the eliminating water loss including means includes installing a sealant between the first overlap extension and the second overlap extension.

* * * * *